US006691478B2

(12) United States Patent
Daudet et al.

(10) Patent No.: US 6,691,478 B2
(45) **Date of Patent: *Feb. 17, 2004**

(54) JOIST SUPPORT APPARATUS

(75) Inventors: Larry Randall Daudet, Porter, IN (US); Gregory S. Ralph, Valparaiso, IN (US); Edmund L. Ponko, Pittsburgh, PA (US)

(73) Assignee: Dietrich Industries, Inc., Pittsburgh, PA (US)

( * ) Notice: Subject to any disclaimer, the term of this patent is extended or adjusted under 35 U.S.C. 154(b) by 52 days.

This patent is subject to a terminal disclaimer.

(21) Appl. No.: 10/145,471

(22) Filed: May 14, 2002

(65) Prior Publication Data

US 2002/0134036 A1 Sep. 26, 2002

Related U.S. Application Data

(63) Continuation of application No. 09/723,899, filed on Nov. 28, 2000, which is a continuation of application No. 09/199,661, filed on Nov. 25, 1998, now Pat. No. 6,301,854.

(51) Int. Cl.[7] ..... E04B 1/00

(52) U.S. Cl. ..... 52/289; 52/262; 52/650.1; 52/651.11; 52/702; 52/741.1

(58) Field of Search ..... 52/262, 263, 264, 52/649.1, 650.1, 650.3, 651.11, 653.1, 654.1, 655.1, 656.1, 656.9, 702, 712, 289, 741.1

(56) References Cited

U.S. PATENT DOCUMENTS

| | | | |
|---|---|---|---|
| 741,066 | A | 10/1903 | O'Shea |
| 947,514 | A | 1/1910 | Stevens |
| 1,656,741 | A | 1/1928 | Lane |
| 1,682,202 | A | 8/1928 | Vaugn |
| 2,106,084 | A | 1/1938 | Coddington |
| 2,145,407 | A | 1/1939 | Soule |
| 2,185,475 | A | 1/1940 | Rafter |
| 2,744,590 | A | 5/1956 | Butts |
| 2,964,807 | A | 12/1960 | Kennedy |
| 2,966,708 | A | 1/1961 | Freeman, Jr. |
| 3,010,162 | A | 11/1961 | Klein |
| 3,083,794 | A | 4/1963 | Stoval, Jr. |
| 3,201,874 | A | 8/1965 | Christy |
| 3,668,828 | A | 6/1972 | Nicholas et al. |
| 3,685,866 | A | 8/1972 | Patenaude |

(List continued on next page.)

FOREIGN PATENT DOCUMENTS

| | | |
|---|---|---|
| AU | 23961/77 | 12/1978 |
| AU | 622263 | 4/1992 |
| AU | 24938/71 | 8/2000 |

(List continued on next page.)

OTHER PUBLICATIONS

Marino Industries Corporation; *Stud–Rite Lightweight Steel Framing*, 1982, p. 12, Westbury, NY.

(List continued on next page.)

*Primary Examiner*—Carl D. Friedman
*Assistant Examiner*—Brian E. Glessner
(74) *Attorney, Agent, or Firm*—Kirkpatrick & Lockhart LLP

(57) ABSTRACT

An apparatus for supporting a plurality of joists. In one embodiment, the apparatus may include a joist rim having a web and first and second rim legs extending substantially perpendicularly from the web. The apparatus may also include a plurality of joist attachment tabs integrally formed in the web. Each of the joist attachment tabs may extend from the web at an angle relative to the web and form a corresponding opening in the web. The apparatus may include at least two reinforcing ribs between at least two adjacent openings. In another embodiment the apparatus may include joist locator tabs not attached to the joists.

3 Claims, 13 Drawing Sheets

U.S. PATENT DOCUMENTS

| | | | | | |
|---|---|---|---|---|---|
| 3,717,964 | A | | 2/1973 | Brown et al. | |
| 3,751,870 | A | | 8/1973 | Vesei | |
| 3,818,662 | A | | 6/1974 | DeSchutter | |
| 3,845,601 | A | | 11/1974 | Kostecky | |
| 3,854,192 | A | | 12/1974 | O'Konski | |
| 3,854,601 | A | | 12/1974 | Kostecky | |
| 3,908,328 | A | | 9/1975 | Nelsson | |
| 3,973,367 | A | * | 8/1976 | Johnson et al. | 52/15 |
| 4,002,001 | A | | 1/1977 | Uydess | |
| 4,016,700 | A | | 4/1977 | Blomstedt | |
| 4,042,991 | A | | 8/1977 | Macy et al. | |
| 4,047,348 | A | | 9/1977 | McSweeney | |
| 4,058,941 | A | | 11/1977 | Zakrzewski et al. | |
| 4,075,807 | A | | 2/1978 | Alderman | |
| 4,075,810 | A | | 2/1978 | Zakrzewski et al. | |
| 4,078,347 | A | | 3/1978 | Eastman et al. | |
| 4,194,328 | A | | 3/1980 | Pierson et al. | |
| 4,197,952 | A | | 4/1980 | DeFouw et al. | |
| 4,229,915 | A | | 10/1980 | Snow et al. | |
| 4,246,736 | A | | 1/1981 | Kovar et al. | |
| 4,288,958 | A | | 9/1981 | Chalmers et al. | |
| 4,385,476 | A | | 5/1983 | Slager | |
| 4,490,956 | A | | 1/1985 | Palacio et al. | |
| 4,538,391 | A | | 9/1985 | Skrabis et al. | |
| 4,551,957 | A | | 11/1985 | Madray | |
| 4,566,818 | A | | 1/1986 | Schwartz et al. | |
| 4,608,801 | A | | 9/1986 | Green et al. | |
| 4,616,453 | A | | 10/1986 | Sheppard, Jr. et al. | |
| 4,625,948 | A | | 12/1986 | Lustvee | |
| 4,637,195 | A | | 1/1987 | Davis | |
| 4,660,799 | A | * | 4/1987 | Butland | 248/317 |
| 4,688,358 | A | | 8/1987 | Madray | |
| 4,761,928 | A | | 8/1988 | Pichette | |
| 4,793,113 | A | | 12/1988 | Bodnar | |
| 4,827,681 | A | | 5/1989 | Platt | |
| 4,866,899 | A | | 9/1989 | Houser | |
| 4,894,967 | A | | 1/1990 | Morton | |
| 4,909,007 | A | | 3/1990 | Bodnar | |
| 4,912,894 | A | | 4/1990 | Platt | |
| 4,918,899 | A | | 4/1990 | Karytinos | |
| 5,137,390 | A | | 8/1992 | Felsen | |
| 5,149,221 | A | | 9/1992 | Slapsys | |
| 5,157,883 | A | | 10/1992 | Meyer | |
| 5,165,555 | A | | 11/1992 | Anatalio | |
| 5,207,045 | A | | 5/1993 | Bodnar | |
| 5,274,973 | A | | 1/1994 | Liang | |
| 5,289,665 | A | | 3/1994 | Higgins | |
| 5,313,752 | A | | 5/1994 | Hatzinikolas | |
| 5,353,560 | A | | 10/1994 | Heydon | |
| 5,394,665 | A | | 3/1995 | Johnson | |
| 5,412,919 | A | | 5/1995 | Pellock et al. | |
| 5,426,906 | A | | 6/1995 | McCracken | |
| 5,527,625 | A | | 6/1996 | Bodnar | |
| 5,592,848 | A | | 1/1997 | Bodnar | |
| 5,596,859 | A | | 1/1997 | Horton et al. | |
| 5,625,995 | A | | 5/1997 | Martin | |
| 5,657,596 | A | * | 8/1997 | Powers, III | 403/231 |
| 5,664,392 | A | | 9/1997 | Mucha | |
| 5,671,580 | A | | 9/1997 | Chou | |
| 5,687,538 | A | | 11/1997 | Frobosilo et al. | |
| 5,689,922 | A | | 11/1997 | Daudet | |
| 5,857,306 | A | | 1/1999 | Pellock | |
| 5,870,874 | A | * | 2/1999 | Brothers | 52/696 |
| 5,956,916 | A | | 9/1999 | Liss | |
| 5,964,071 | A | | 10/1999 | Sato | |
| D423,325 | S | | 4/2000 | Liss | |
| 6,131,358 | A | * | 10/2000 | Wise | 52/289 |
| 6,170,217 | B1 | * | 1/2001 | Meyer | 29/897.31 |
| 6,230,467 | B1 | | 5/2001 | Leek | |
| 6,301,854 | B1 | | 10/2001 | Daudet et al. | |
| 6,354,055 | B1 | * | 3/2002 | Shaw et al. | 52/696 |
| 6,418,694 | B1 | | 7/2002 | Daudet et al. | |

FOREIGN PATENT DOCUMENTS

| | | | | | |
|---|---|---|---|---|---|
| CA | 1055219 | | | 5/1979 | |
| CA | 1192015 | | | 8/1985 | |
| CA | 2077170 | | | 8/1992 | |
| EP | 0080088 | | | 6/1983 | |
| EP | 0373727 | | | 6/1990 | |
| EP | 0637656 | | | 2/1995 | |
| FR | 2362251 | | | 3/1978 | |
| GB | 1566160 | | | 4/1980 | |
| GB | 2103264 | A | | 2/1983 | |
| GB | 2128219 | A | | 4/1984 | |
| GB | 2171731 | A | | 9/1986 | |
| GB | 2272715 | | | 5/1994 | |
| JP | 6-49908 | | | 2/1994 | |
| JP | 406049908 | A | * | 2/1994 | 52/702 |
| JP | 9-4067 | | | 1/1997 | |

OTHER PUBLICATIONS

Zinc Institute Inc., *Residential Steel Frame Construction, Builder's Guide to Lightweight Zinc–Coated Steel*, 1987, New York, NY.

Dale//Incor, *Manufacturer of Steel Framing Systems*, 1989, p. 1–36, Pewailee, WI.

Dietrich Industries, Inc., *Light Gage Steel Framing Typical Construction Details*, 10/94, 1–33, Pittsburgh, PA.

Unimast Incorporated, *Steel Framing Systems Technical Information*, 1991, 1–40, Franklin, IL.

American Society of Civil Engineers, *Composite Contruction in Steel and Concrete II*, Dec. 9, 1993, p. 882–899, New York, NY.

Construction Steel Design, *Hollow Section Column to Open Section Beam Connections—Design Appraisal*, 106–214, 1992, England.

American Iron and Steel Institute, *Low–Rise Residential Construction Details*, Jun., 1993, Washington, DC.

E. N. Lorre, *Residential Steel Framing Construction Guide*, 1993, Laguna Hills, CA.

Delta Metal Products, Inc., *Residential Steel Frame Construction*, Jun., 1994, 1–13.

MarinoWare, *Stud–Rite Lightweight Steel Framing Systems*, 1–35, 1994, Hunt Valley, MD.

Dietrich Industries, Inc., *Curtain Wall/Light Gage Structural Framing Products*, 1–16, 1995, Pittsburgh, PA.

U.S. Department of Housing and Urban Development, *Prescriptive Method for Residential Cold–Formed Steel Framing Second Edition*, p. 1–93, Sep., 1997, Rockville, MD 20849.

Monex Corporation; *Monex Steel Framing*, Publication date unknown, North Miami Beach, FL.

National Gypsum Company, *Gold Bond Metal Products for Interior Finishing*, Sep. 1981, Charlotte, NC.

Angles Metal Systems, Technical Data Sheets 101, 102, 107, 108, 113, 114, 115, 116, 117, 118, 119, and 120; 1984, Los Angeles, CA.

Angles Metal Systems, Inc.; *Steel Frame Program*; publication date unknown.

Clark Steel Framing Systems, *Clark Sructural Framing*; 1995.

Cemco, *Steel Framing Systems*, 1996, Industry, CA.

USG Interiors, Inc., *Ceiling Suspension Systems*, Jan., 1991, Chicago, IL.

G–P Gypsum Corporation, *Gyproc Shaftwall/Stairwall Systems*, Mar., 1997, USA.
Steel Floors LLC, *Monthly New Letter*, Oct., 1998, Greenwood Village, CO.
Steel Floors LLC, *Monthly New Letter*, Jun., 1998, Greenwood Village, CO.
Steel Floors LLC, *Monthly New Letter*, Feb., 1998, Denver, CO.
Steel Floors LLC, Brochure—*Why Steel Floors*, Publication date unknown.
Steel Floors LLC, *Monthly News Letter*, Nov., 1997, Denver, CO.
Sullivan, Steel Framing: *Thermally Challenged, JLC*, Mar. 1994.

Dietrich Industries, Inc., a portion of a brochure published concerning J–Track, published at least as early as Dec. 1991, p. 2, Pittsburgh, PA.

Dietrich Industries, Inc., *1st Step to Residential Metal Framing* (*non–load Bearing Walls*), Jun., 1994, Pittsburgh, PA.

NAHB, Homebase News, Spring 1999, Upper Marlboro, MD.

Response to Patent Owner's Statement in Reexmination Control No. 90/005,970.

* cited by examiner 38
80
64
38
38
38

JOIST SUPPORT APPARATUS

CROSS-REFERENCE TO RELATED APPLICATIONS

This application is a continuation of U.S. patent application Ser. No. 09/723,899, filed Nov. 28, 2000, which is a continuation of U.S. patent application Ser. No. 09/199,661, filed Nov. 25, 1998, and issued as U.S. Pat. No. 6,301,854.

BACKGROUND OF THE INVENTION

1. Field of the Invention

The subject invention relates to building components and, more particularly, to floor joists and floor systems fabricated from metal.

2. Description of the Invention Background

Traditionally, the material of choice for new residential and commercial building framing construction has been wood. However, over the years, the rising costs of lumber and labor required to install wood framing components have placed the dream of owning a newly constructed home out of the economic reach of many families. Likewise such increasing costs have contributed to the slowing of the development and advancement of urban renewal plans in many cities. Other problems such as the susceptibility to fire and insect damage, rotting, etc. are commonly associated with wood building products. Additional problems specifically associated with wooden floor joists include cost, availability and quality. These problems are particularly acute with respect to larger joists which must be harvested from large old growth forests which are becoming depleted.

In recent years, in an effort to address such problems, various alternative building materials and construction methods have been developed. For example, a variety of metal stud and frame arrangements have been developed for use in residential and/or commercial structures. U.S. Pat. No. 3,845,601 to Kostecky discloses such a metal wall framing system. While such system purports to reduce assembly costs and the need for welding or separate fasteners, several different parts are, nonetheless, required to complete the wall frame system which can be time consuming and expensive to inventory and assemble. Such components must also be manufactured to relatively close tolerances to ensure that they will fit together properly thereby leading to increased manufacturing costs. Other metal stud systems for fabricating walls are disclosed in U.S. Pat. No. 3,908,328 to Nelsson, U.S. Pat. No. 4,078,347 to Eastman et al., U.S. Pat. No. 4,918,899 to Karytinos, U.S. Pat. No. 5,394,665 to Johnson, and U.S. Pat. No. 5,412,919 to Pellock et al. Such patents are particularly directed to wall system constructions and do not address various problems commonly encountered when installing floor and/or ceiling joists and support structures therefor within a building.

Conventional floor construction methods typically comprise installing "header" members on the top of support walls that may be fabricated from, for example, concrete blocks, wood or metal studs. The header members typically comprise wood beams that are supported on edge on the wall. Other wood beam members, commonly referred to as joists, are used to span from wall to wall between the headers and are usually connected to the headers by nails. The joists are typically arranged parallel to each other with 8", 16" or 24" between their respective centers, depending upon the load characteristics that the floor must accommodate. A sheathing material such as plywood is then nailed to the upper edges of the joists to form the floor surface. To prevent the joists from inadvertently twisting or moving laterally, small pieces of wood, known as blocking pieces, are commonly nailed between adjacent joists to form, in many instances, X-shaped braces between the joists. Insulation is sometimes installed between the joists and sheathing, drywall, plasterboard, etc. is then applied to the bottom of the joists to form a ceiling for the space located under the floor joist system.

While these materials and floor construction arrangements have been used for many years in residential and commercial construction applications, they have many shortcomings that can contribute to added labor and material costs. For example, when connecting the joists to their respective headers, the carpenter must first measure and mark the headers to establish the desired joist spacing. This additional step increases the amount of construction time required to install the floor system and, thus, results in increased construction costs. After the headers are installed, the joists must be properly nailed to the headers. If the carpenter has access to the opposite side of the header from which the joist is to be installed, the nails are hammered through the header into the end of the respective joist. If, however, the carpenter cannot access the opposite side of the header, nails must be inserted at an angle (commonly referred to as "toenailing", through the joist and into the header. Care must be taken to avoid inadvertently splitting the joist and to ensure that the nails extend through the joist and into the header a sufficient distance. Such attachment process can be time consuming and may require the use of skilled labor which can also lead to increased construction costs. If toenailing is not structurally acceptable, another piece, called a joist hanger must be added which also increases labor and material costs.

It is also often desirable to install ductwork, piping, electrical wires, etc. within the floor joist system so that they do not occupy living space and are concealed by the ceiling material that is attached to the bottom of the joists. To accommodate those elements that must span multiple joists, passageways and/or holes must be provided through the joists. The number, size, and location of such passageways/holes must be carefully considered to avoid compromising the structural integrity of the joists. Furthermore, the blocking members may have to be moved or eliminated in certain instances to permit the ductwork and/piping to pass between the joists. In addition, cutting such passageways/holes into the joists at the construction site is time consuming and leads to increased labor costs. Another shortcoming associated with such floor joist systems is the difficulty of installing insulation between the joists due to the blocking members.

As noted above, there are many shortcomings associated with the use of wood floor joists and headers. In an effort to address some of the above-noted disadvantages, metal beams have been developed. For example, U.S. Pat. No. 4,793,113 to Bodnar discloses a metal stud for use in a wall. U.S. Pat. No. 4,866,899 to Houser discloses a metal stud that is used to support wallboard panels for forming a fire-rated wall and is not well-suited for supporting structural loads. U.S. Pat. No. 5,527,625 to Bodnar discloses a roll formed metal member with reinforcement indentations which purport to provide thermal advantages. The studs and metal members disclosed in those patents, however, fail to address many of the above-noted shortcomings and can be time consuming to install. Furthermore, many of the metal beams, studs, etc. disclosed in the above-mentioned patents typically must be cut in the field using hand tools. Such cuts often result in sharp, ragged edges which can lead to premature failure of the component when it is placed under a load.

In an apparent effort to better facilitate installation of various beams, U.S. Pat. No. 3,688,828 to Nicholas et al. discloses the use of L-shaped brackets to facilitate attachment of eaves boards and rafters to a C-shaped channel. While such arrangement may reduce assembly costs at the construction site, such brackets must be welded or separately affixed to the C-shaped channel which is time consuming and leads to increased manufacturing and fabrication costs. Furthermore, significant skill is typically required to properly layout and align the brackets.

Currently, metal floor joist material is generally cost-competitive with wood material. However, the nuances of assembling existing metal joists generally make them non-competitive when compared with wood joist arrangements.

Thus, there is a need for a floor joist that is relatively inexpensive to manufacture and install.

There is a further need for a floor joist that can permit the passage of ductwork, piping, electrical wires, etc. therethrough without compromising the structural integrity of the joist and without encountering the on-site labor costs associated with cutting openings in the wood joists.

There is still another need for a joist support system that can be easily installed without the need for skilled labor.

Another need exists for a joist header that has a plurality of joist attachment locations pre-established thereon thus eliminating the need for the installers to layout each header.

Yet another need exists for a joist header that is relatively lightweight and that can be used to support metal or wooden joists in predetermined locations.

Another need exists for a joist header that has openings provided therein which can accommodate the passage of piping and/or wiring therethrough.

Still another need exists for a joist blocking member that can be attached between joists that is easy to install and can facilitate easy installation of insulation between joists.

A further need exists for a joist system that can, in some applications, eliminate the need for headers in support walls at window and door locations.

A need also exists for a joist support system that has the above-mentioned attributes that is easy to install and eliminates or reduces the amount of on-site cutting commonly associated with prior wood and metal joist components.

Yet another need exists for a floor joist system that eliminates the need to use a double 2"×4" wooden top plate to effectively distribute the load from the joists to the wall studs.

Still another need exists for a floor support system that can be easily used on connection with support structures of like and dissimilar constructions.

SUMMARY OF THE INVENTION

In accordance with a particularly preferred form of the present invention, there is provided a joist support apparatus that comprises a rim member that has a web portion and at least one attachment tab integrally formed in the web portion for attachment to a joist.

The subject invention may also comprise a member for supporting at least one joist member. The member may include a C-shaped rim member that is fabricated from metal and has a web and two leg portions. In addition, a plurality of joist attachment tabs are integrally formed in the web wherein the joist attachment tabs are provided at predetermined distances on the web relative to each other. At least one reinforcing rib corresponding to each tab is provided in the web adjacent the corresponding tab. The hole provided in the web when the tab is formed provides a convenient opening for passing pipes, wires, etc. through the rim member.

Another embodiment of the subject invention comprises apparatus for laterally supporting two joists. The apparatus may comprise a metal blocking member that has a body portion that is sized to extend between the two joists. The body portion may also have two opposing end tabs that are integral with the body portion and are substantially coplanar therewith. Each end tab corresponds to one of the joists for attachment thereto.

The subject invention may include a floor joist system that includes at least two joists that each have two ends and at least two joist rims that each have an attachment tab integrally formed therein that corresponds to one of the ends of the joists for attachment thereto.

Another embodiment of the present invention may include at least two metal joists that are substantially C-shaped such that each joist has a central web portion and an upper and lower leg portion protruding from the central web portion. Each central web portion has at least one opening therethrough that has a circumference and a reinforcing lip that extends around the circumference. The subject invention may also include at least one metal joist rim that is substantially C-shaped and has a rim web and an upper and lower rim leg protruding therefrom. The rim web is sized such that the end of a corresponding metal joist can be abutted substantially perpendicularly to the rim web of the corresponding joist rim and be received between the upper and lower rim legs thereof. The rim web of each joist rim further has at least one attachment tab integrally formed therein corresponding to each end of each corresponding joist. The attachment tab is substantially parallel to the corresponding joist end for attachment thereto. The rim web further has at least one reinforcing rib therein adjacent to each tab. The subject invention may further include at least one blocking member that has a body portion sized to extend between two joists. The blocking member has a body portion and two opposing end tabs integral with the body portion wherein each end tab corresponds to one of the joists for attachment thereto.

The subject invention may also comprise a method for constructing a floor between two spaced-apart support structures. The method may include supporting a joist rim on each support structure wherein the joist rim has a plurality of attachment tabs integrally formed therein. The joist rims are supported on said spaced-apart support structures such that the attachment tabs of one joist rim are substantially aligned with corresponding attachment tabs on the other joist rim. The method may also include attaching a joist corresponding to each pair of aligned attachment tabs such that the joists extend between the joist rims and are attached thereto. Each joist has a top surface such that when the joists extend between the joist rims and are attached to the aligned attachment tabs, the top surfaces of the joists are substantially coplanar with each other. The method may also include attaching a blocking member between adjacent joists to provide lateral support thereto and attaching sheathing to the coplanar top surfaces of the joists.

It is a feature of the present invention to provide a floor joist that is relatively inexpensive to manufacture and install.

It is another feature of the present invention to provide a floor joist that can permit the passage of ductwork, piping, electrical wires, etc. therethrough without compromising the structural integrity of the joist and without encountering the on-site labor costs associated with cutting openings in the joists.

Another feature of the present invention involves the provision of a joist support system that can be easily installed without the need for skilled labor.

Yet another feature of the present invention is to provide a joist rim that reduces or eliminates the need for conventional web stiffeners.

Another feature of the present invention is to provide a joist rim that facilities easy passage of wires, pipes, etc. therethrough without the need to cut holes in the rim in the field and without compromising the structural integrity of the rim.

Still another feature of the present invention is to provide a floor joist support system that does not require the installation of a variety of different fastener parts that are commonly associated with prior metal beam and stud installations.

Another feature of the present invention is to provide a floor joist rim that can effectively distribute loads that, in the past, typically had to be accommodated by using double wood plates and the like.

It is another feature of the present invention to provide a joist header or rim that has a plurality of joist attachment locations pre-established thereon thus eliminating the need for the installers to layout each header.

Still another feature of the subject invention is to provide a pre-formed joist rim or header that is relatively lightweight and that can be used to support metal or wooden joists in predetermined locations.

It is another feature of the present invention to provide a pre-formed joist blocking member that is easy to install and that can facilitate easy installation of insulation between joists.

An additional feature of the subject invention is to provide a floor system that can, in some applications, eliminate the need for headers in support walls at window and door locations.

Still another feature of the present invention is to provide a joist support system that has the above-mentioned attributes and that is easy to install and eliminates or reduces the amount of on-site cutting and measuring commonly associated with prior wood and metal joist components.

Yet another feature of the present invention is to provide a floor system that can be successfully used in connection with support structures of dissimilar construction.

Accordingly, the present invention provides solutions to the shortcomings of prior building components and floor systems. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

Figure 1:
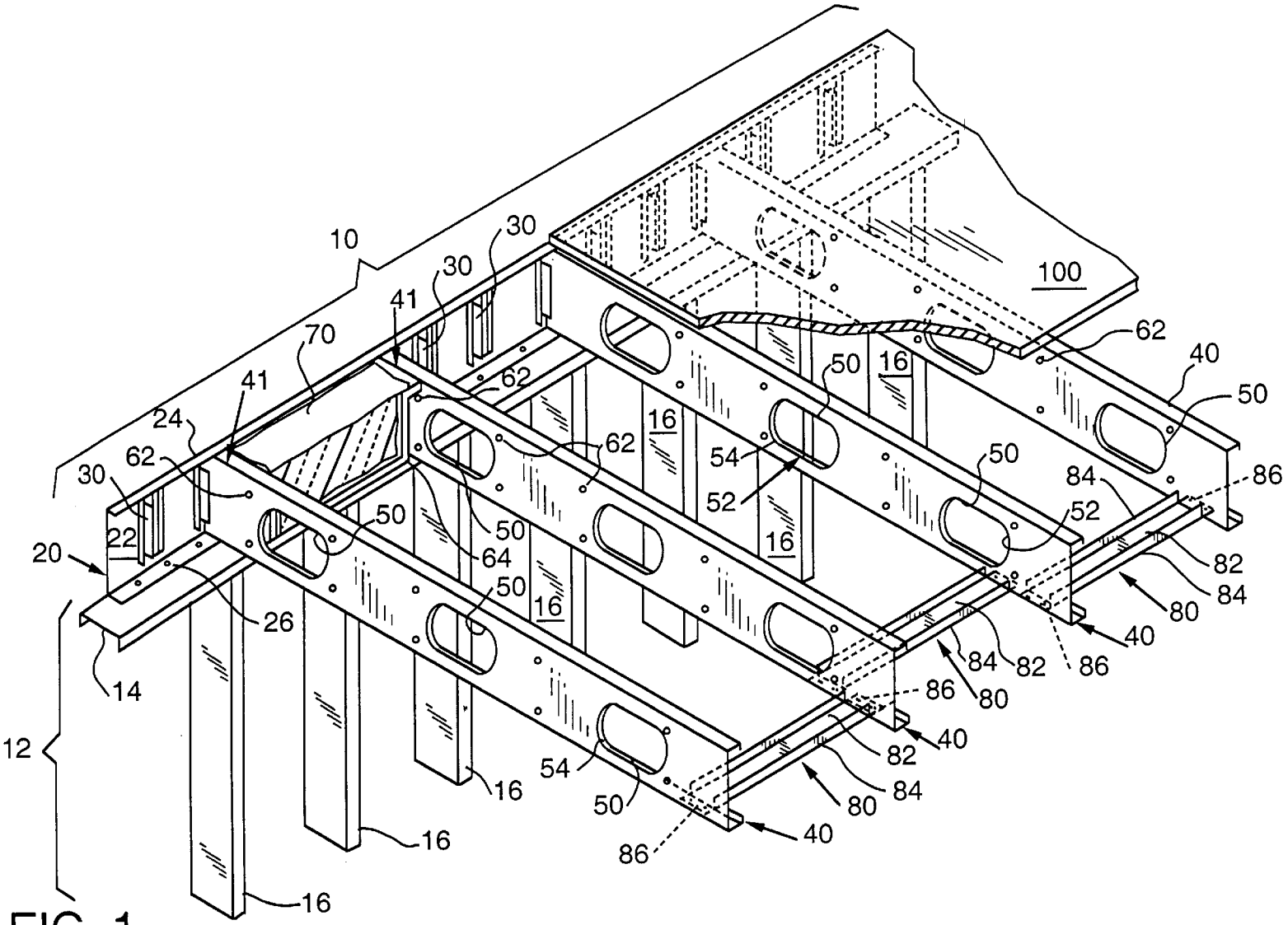
FIG. 1 is a partial perspective view of a floor system of the subject invention.

Referring now to the drawings for the purposes of illustrating the present preferred embodiments of the invention only and not for the purposes of limiting the same, the Figures show a floor system 10 of the present invention that may be used advantageously in residential and commercial applications, alike. More particularly and with reference to FIG. 1, a floor system 10 of the present invention may include at least two headers or joist rims 20 that are supported on corresponding wall structures 12. As shown in FIG. 1, the wall structure 12 may comprise a C-shaped metal top track member 14 and a plurality of metal wall studs 16 that are attached to the top track member 14 by conventional fastener screws and techniques. Those of ordinary skill in the art will appreciate that the floor system 10 of the present invention may be successfully employed with a variety of different wall or other supporting structures that may be fabricated from wood, concrete block, etc.

The floor system 10 may also comprise a plurality of joists 40 that are adapted to span between wall structures 12 and have their respective ends attached to the joist rims 20. FIG. 1 only shows one joist rim 20 and its corresponding wall structure 12. The reader will appreciate that the joists 40 may span from one wall structure 12 to another wall or support structure (not shown) and are attached to corresponding joist rims 20 in a manner described in further detail below.

Figure 2:
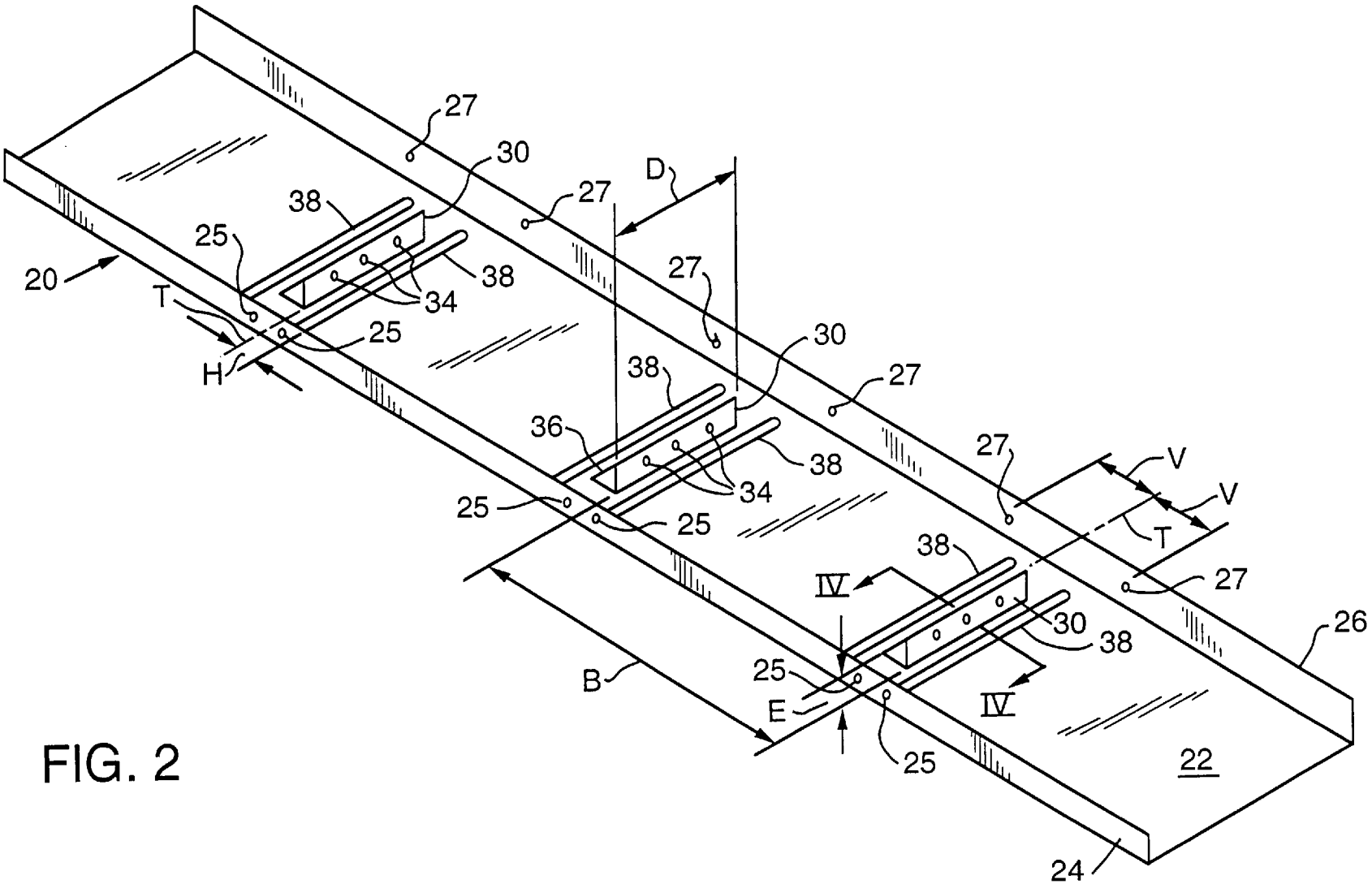
FIG. 2 is an inside isometric view of a joist rim of the present invention.
Figure 3:
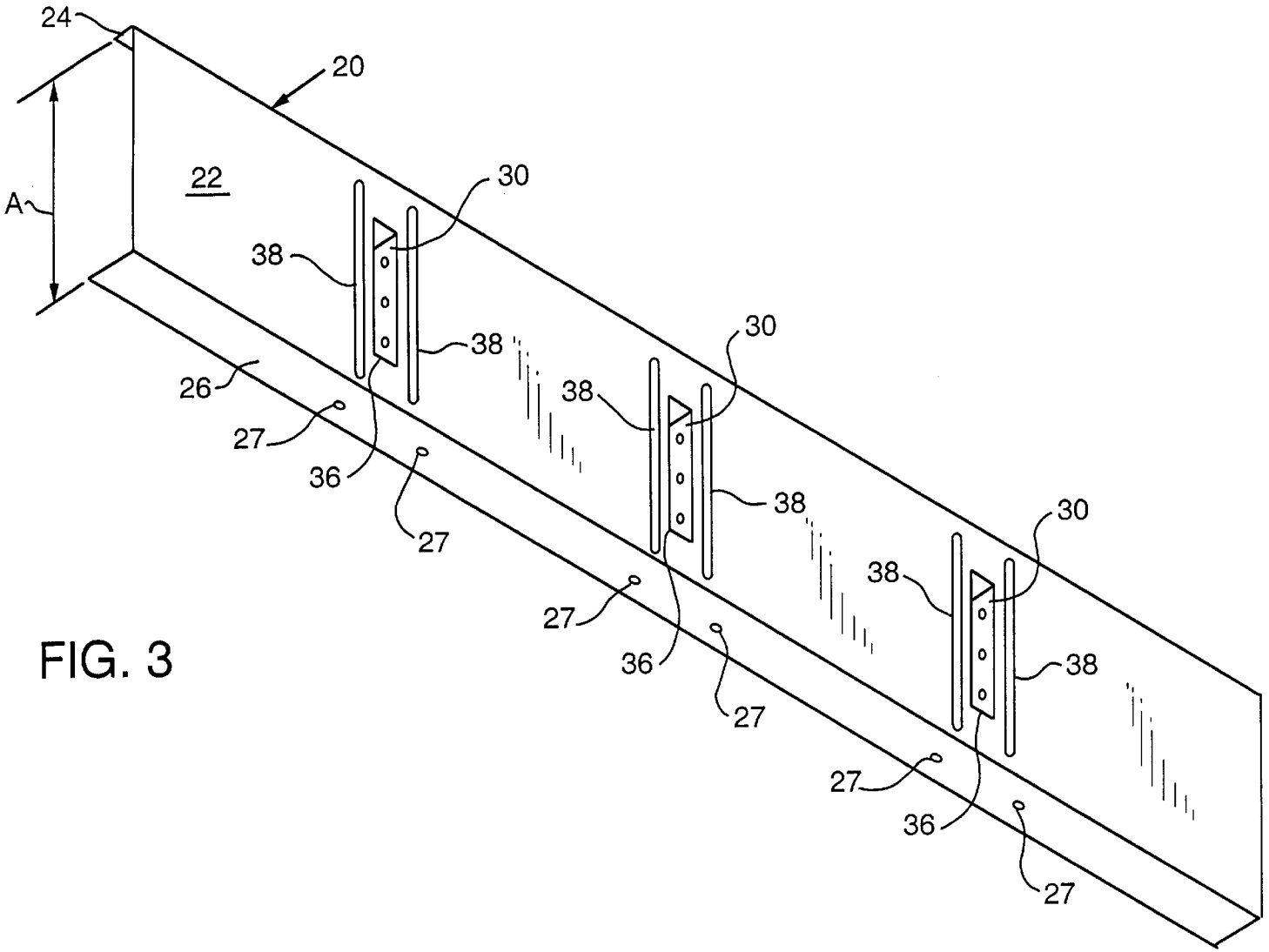
FIG. 3 is an outside isometric view of the joist rim of FIG. 2.

FIGS. 2 and 3 depict a joist rim 20 of the subject invention. The joist rim 20 may be fabricated from, for example, cold rolled galvanized steel or other suitable metal, the gauge of which may be dependent upon the amount and types of loads that the floor system 10 must support. For example, for a floor system that is designed to support loads of forty pounds per square foot, the joist rim 20 may be fabricated from 16 gauge cold rolled steel. As can be seen in FIGS. 1–3, a joist rim 20 may be substantially C-shaped when viewed from the end and have a central web portion 22 and an upper rim leg 24 and a lower rim leg 26. In the above example, the distance "A" may be, for example, ten inches. The skilled artisan will appreciate, however, that the overall size of the joist rim 20 will be somewhat dependent upon particular design characteristics, such as floor loading, joist spacing, deflection criteria, etc. The reader will also appreciate that the joist rim 20 may be initially formed utilizing conventional roll forming techniques. In a preferred embodiment, the lower rim leg 26 may be longer than the upper rim leg 24. The lower leg 26 may extend from the web 22 at a distance of, for example, 2.5" to facilitate easy attachment of the joist rim 20 to all types of supporting structures.

As can also be seen in FIGS. 2 and 3, a joist rim is provided with a plurality of integrally formed attachment tabs 30 for affixing the ends 41 of the joists 40 thereto. The attachment tabs 30 may be provided in the joist rim 20 at any desired interval (distance "B" in FIG. 2). However, those of ordinary skill in the art will appreciate that it may be advantageous to provide the attachment tabs 30 at intervals of 8", 16", or 24". It will be further appreciated that, depending upon the particular wall structure construction, wall studs 16 are often spaced at such intervals. Thus, by integrally forming the attachment tabs 30 at those intervals, the joists 40 can be arranged to overlay corresponding studs 16 in the wall structure 12 for load distribution purposes. In the alternative, due to the load distribution capabilities of the joist rim of the present invention, the studs forming the wall structures could be dissimilarly spaced relative to the joists. That is, the unique and novel characteristics of the present rim joist can eliminate the need for vertically aligning wall studs over corresponding joists. The skilled artisan will further appreciate that by forming an attachment tab 30 at every eight inch interval, the installer can choose to affix the joists 40 at any of those intervals (i.e., 8", 16", 24").

The attachment tabs 30 of the present invention are preferably integrally formed in the web portion 22 of the joist rim 20 by punching three-sided, rectangular flaps or tabs out of the web 22 and bending the tabs 30 at a predetermined angle relative to the plane of the web 22. In a preferred embodiment, the tabs 30 are bent at 90° relative to the web 22 (angle "C" in FIG. 4). However, the tabs 30 could be oriented at other suitable angles depending upon the application. The tabs 30 may be punched into the web 22 utilizing conventional metal punching techniques and equipment. Also, to facilitate quick attachment of the joists 40 to the tabs 30, a series of fastener holes 34 may be punched through the web to accommodate conventional sheet metal fasteners such as, for example, self-drilling screws. For example, in applications wherein distance A is approximately 10", the length of a tab 30 may be 6" (distance "D", and the width of a tab 30 may be 1" (distance "E"). By way of additional examples, the tabs 30 may be 1"×4" for joist rims adapted to support joists that are 7.25", 8" and 9.25" high or tabs 30 may be 1"×6" for joist rims adapted to support joists that are 10", 11.25", 12" and 14" high. The skilled artisan will appreciate that the integrally formed tabs 30 may be provided in a variety of different sizes and shapes without departing from the spirit and scope of the present invention. It will be further appreciated that when the integral tabs 30 are formed and bent to a desired angle relative to the web portion 22, an opening 36 corresponding to each tab 30 is formed through the web 22 of the joist rim 20 which may also be used to permit the passage of wires, pipes, etc. through the joist rim 20.

In some applications, it may be desirable to attach the joists to the upper legs 24 of the joist rim 20. To facilitate such attachment, a plurality of holes 25 are pre-punched through the upper leg 24 for receiving fastener screws therethrough. By way of example, as can be seen in FIG. 2, the centerlines of the holes 25 may be equally spaced on each side of the tab centerline "T" approximately 1" (distance "U"). However, other hole arrangements may be provided. Similarly, to facilitate attachment of the rim joist 20 to the structure 14 below, a series of pre-punched holes 27 may be provided in the lower leg 26. For example, holes 27 may be spaced approximately 4" from the centerline "T" of the attachment tab 30 (distance "V") as shown in FIG. 2. However, other hole arrangements may be employed. Those of ordinary skill in the art will appreciate that when the joists are attached to the leg 24, there is generally no need to attach the ends of the joists 40 to the tabs 30 in many loading applications. Conversely, in many cases, if the ends of the joists 40 are attached to the tabs 30, there is no need to attach the joists to the leg 24 of the joist rim 20. Such arrangement also eliminates the need for joist hangers.

Figure 4:
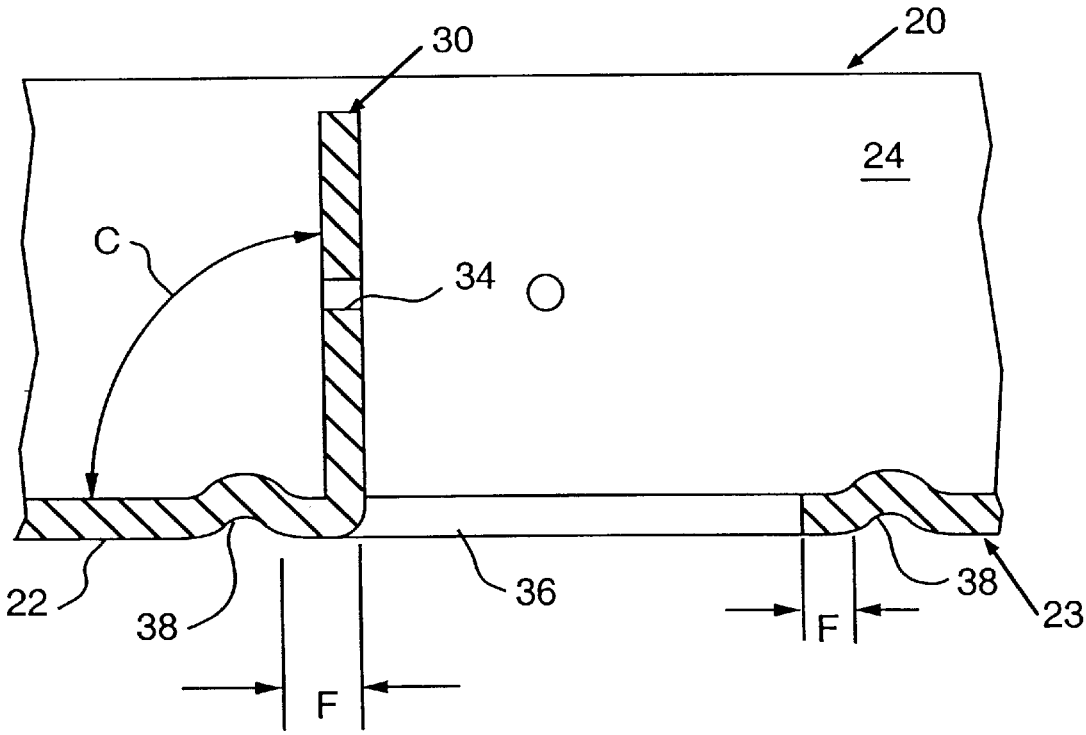
FIG. 4 is a cross-sectional view of a portion of the joist rim of FIGS. 2 and 3 taken along line IV—IV in FIG. 2.

Also, reinforcing ribs 38 may be provided on each side of each opening 36 to provide reinforcement to the web 22 and to permit the attachment tab 30 to function as a structural connection between the joist rim 20 and the corresponding joist 40. We believe that for many applications, such reinforced integral tabs provide sufficient strength to negate the need to fasten the bottom leg of the joist to the bottom leg of the joist rim which can be difficult to make in the field. At least one, and preferably two, ribs 38 are embossed into the web 22 as shown in FIGS. 2, 3, and 4. The ribs 38 may comprise indentations that are embossed into the outer surface 23 of the web 22. Ribs 38 may be ½" wide and ¼" deep and be spaced, for example, approximately 1" from the edges of each corresponding opening 36 (distance "F"). See FIG. 4. Ribs 38 may, for example, be 5" long for joist rims 20 that have webs 22 that are 7.25", 8" and 9.25" long or ribs may be 7" long for joist rims 20 with larger webs 22. The size, shape and location of ribs 38 may be advantageously altered depending upon the loads applied to the joist rim 20 and the size of the joist rim 20. Those of ordinary skill in the art will appreciate that such ribs 38 and tabs 30 may also eliminate the need to employ joist web stiffeners, which could lead to lower joist fabrication costs. The ribs 38 may be formed into the web 22 utilizing conventional roll forming techniques. It will be further appreciated that the rim joist of the present invention has sufficient load distribution characteristics to generally eliminate the need for extra parts commonly associated with prior joist header arrangements. For example, the unique capabilities of the present rim joist 20 eliminates the need to use double 2"×4" plates to distribute the load from the joists to the wall studs—a common practice employed in the past.

Figure 4A:
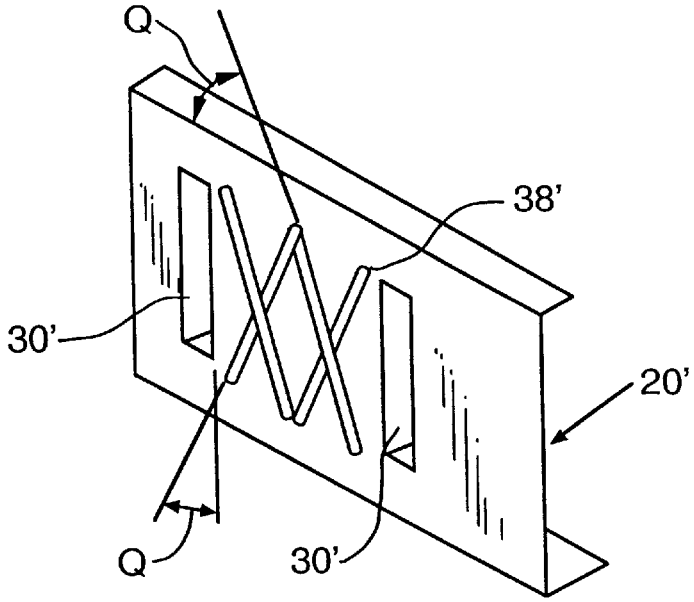
FIG. 4*a* is an outside isometric view of another embodiment of the joist rim of the present invention.

Another embodiment of the rim joist of the present invention is illustrated in FIG. 4*a*. In this embodiment, the rim joist 20' is essentially identical in construction to the rim joist 20 described above, except for the configuration of the ribs 38'. As can be seen in FIG. 4*a*, the ribs 38' are provided at an approximately 45° degree angle (angle "Q" in FIG. 4*a*) relative to the edges of the joist rim 20' and the attachment tabs 30'. Furthermore, the diagonal ribs 38' may be crossed as shown to provide additional strength and stiffness to the web portion 22'. Multiple cross arrangements may be employed between the tabs 30'.

As can be seen in FIG. 4, the attachment tab 30 may be advantageously provided with a series of pre-punched (i.e., punched during fabrication of the joist rim 20 as opposed to being punched in the field with hand tools) holes 34. By pre-punching the holes 34 at desired locations, the installer is assured that the fasteners used to fasten the tab 30 to a joist 40 are placed in the proper location to ensure adequate structural integrity of that connection. Prepunching also reduces the amount of labor required for installation purposes. By way of example, an attachment tab 30 that is 6" long and 1" wide may have three attachment holes 34 therein with their centerlines being approximately 1.5" apart. Those holes may also be aligned on the centerline of the tab 30. Such arrangement and number of fastener holes 34 may be dictated by joist size and composition, loading conditions, etc.

Figure 5:
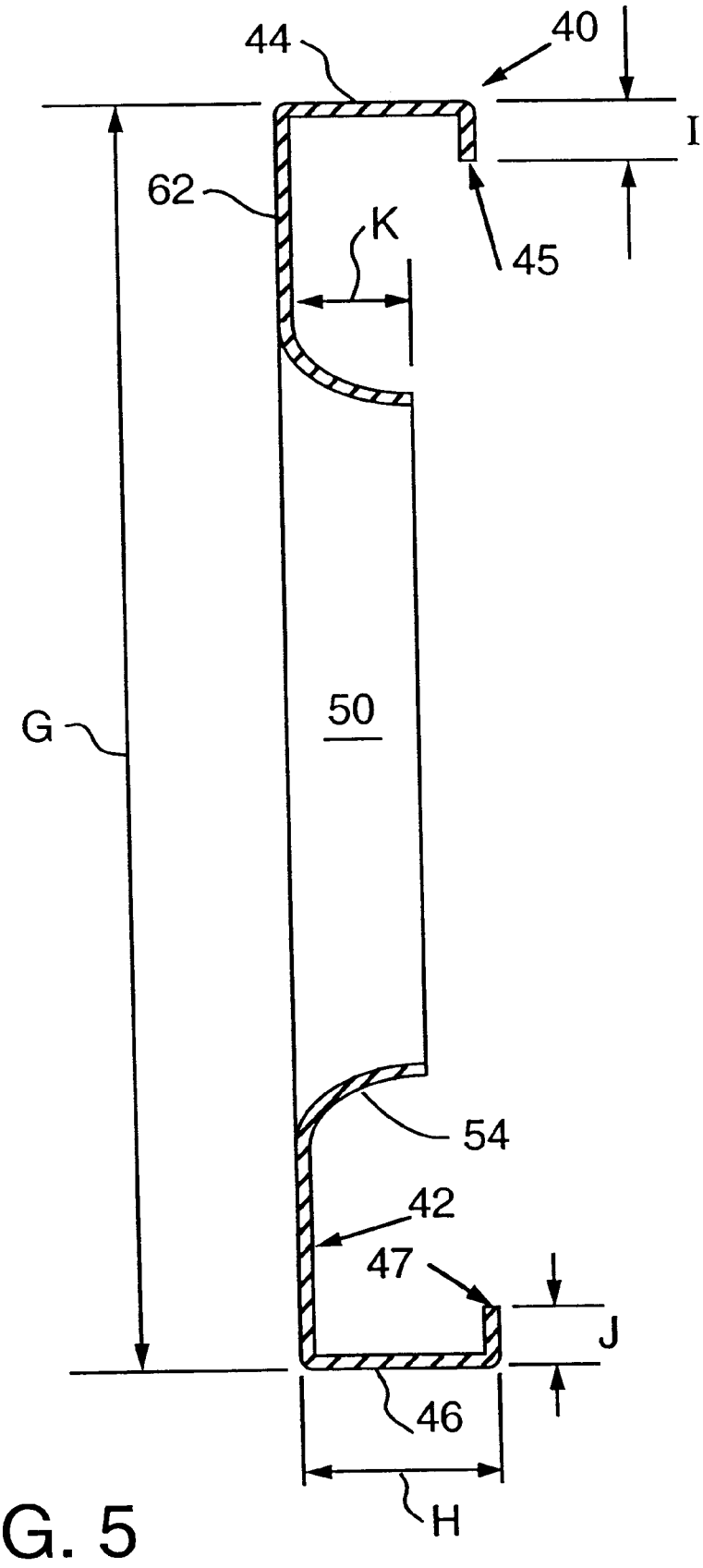
FIG. 5 is cross-sectional view of a joist of the present invention.
Figure 6:
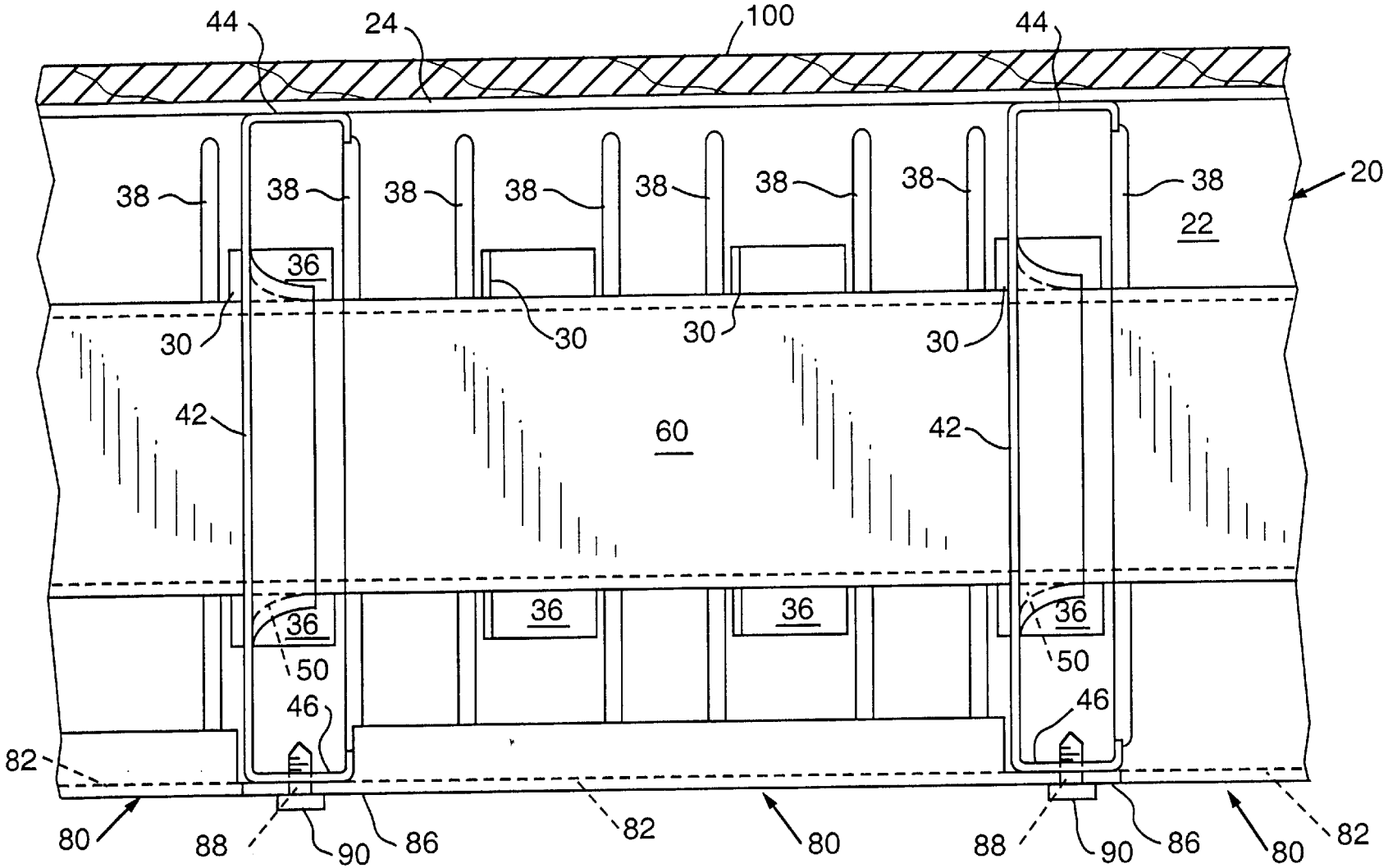
FIG. 6 is a partial cross-sectional view of a floor system of the present invention wherein a duct has been inserted through openings in the joists.

While the skilled artisan will appreciate that the joist rim 20 of the present invention may be advantageously used in connection with wood joists (i.e., 2"×6", 2"×10", 2"×12", etc. beams) and other metal beams, the joist rim 20 particularly works well in connection with metal joists 40 of the type depicted in FIGS. 1, 5, and 6. As can be seen in those Figures, a joist 40 is C-shaped and has a web portion 42 and an upper leg 44 and a lower leg 46. Joists 40 may be fabricated from cold rolled galvanized steel or other suitable metal utilizing conventional roll forming techniques and be sized to accommodate various loading characteristics. For example, a joist 40 sized for use in connection with the joist rim example discussed above may have a height of approximately 10" (distance "G") and the upper and lower legs (44, 46) may each be approximately 1.75" long (distance "H"). The skilled artisan will appreciate that the sizes of the web 42 and the upper and lower legs (44, 46) can vary depending upon the application and may or may not be symmetrical. In addition the ends of the upper and lower legs (44, 46) are bent inwardly to provide the joist 40 with reinforcing lips (45, 47). See FIG. 5. For example, reinforcing lip 45 may be approximately 5/8" long (distance "I") and be bent at an angle of approximately 90° relative to the upper leg 44. Similarly, reinforcing lip 47 may be approximately 5/8" long (distance "J") or some other length and may or may not be symmetrical.

Preferably, joists 40 are sized such that the ends 41 thereof may be abutted against the web portion 22 of a corresponding joist rim 20 such that the lower leg 46 of the joist 40 is received on the lower leg 26 of the joist rim 20 and the upper leg 44 of the joist 40 is under the upper leg 24 of the joist rim 20. To attach the end 41 of the joist 40 to the joist rim 20, conventional fasteners, such as for example, self-drilling screws are inserted through the holes 34 in the corresponding tab 30 and into the web portion 42 of the joist 40. If desired, the lower leg 46 of the joist 40 may be fastened to the lower leg 26 of the joist rim 20 by conventional fasteners. Similarly, the upper leg 44 of the joist 40 may be fastened to the upper leg 24 of the joist rim 20 by inserting conventional fastener screws through pre-punched holes 25 in the upper leg 24.

To permit utility elements such as heating, ventilation and air conditioning ducts, wires, piping, etc. to pass through the joists 40, each joist 40 may be provided with at least one opening 50 through their respective web portions 42. As can be seen in FIG. 1, openings 50 may be oval-shaped to accommodate a variety of differently shaped components. A plurality of openings 50 may be provided through each joist 40. The size, location and number of such openings 50 may be dependent upon considerations such as loading characteristics, and the location and the size of the ducts, pipes, etc. that must be accommodated. To provide the web portion 42 of the joist 40 with additional strength and reinforcement around each opening 50, a rim 54 of material is formed around the circumference 52 of each opening 50. Rim 54 may be formed around the opening 50 by a two progression, one hit, wipe bend draw process. For example, in a joist 40 that has legs (44,46) that are each 1.75" long, the rim 54 may also extend inwardly approximately 11/16" (distance "K"). See FIG. 5. FIG. 6 depicts the floor system 10 described above wherein a section of duct work 60 extends through aligned openings 50 in the joists 40. We have found that the configuration and size of rim 54 permits relatively large openings to be provided through the joist web. For example, a joist manufactured from cold rolled galvanized steel and having a length of 16 feet and that is supported at its ends and placed under a load of forty pounds per square foot can be successfully provided with up to eight equally spaced openings 50 that are approximately 6.25" wide and 9" long. We have also found that the rim 54 prevents the creation of sharp edges that are inherent to punched holes. Thus, rim 54 provides a safer work environment as well as reduces the need for protective devices such as grommets to be installed within such openings to prevent inadvertent damage to the ducts, wires, pipes, etc. that pass through the opening.

Figure 7:
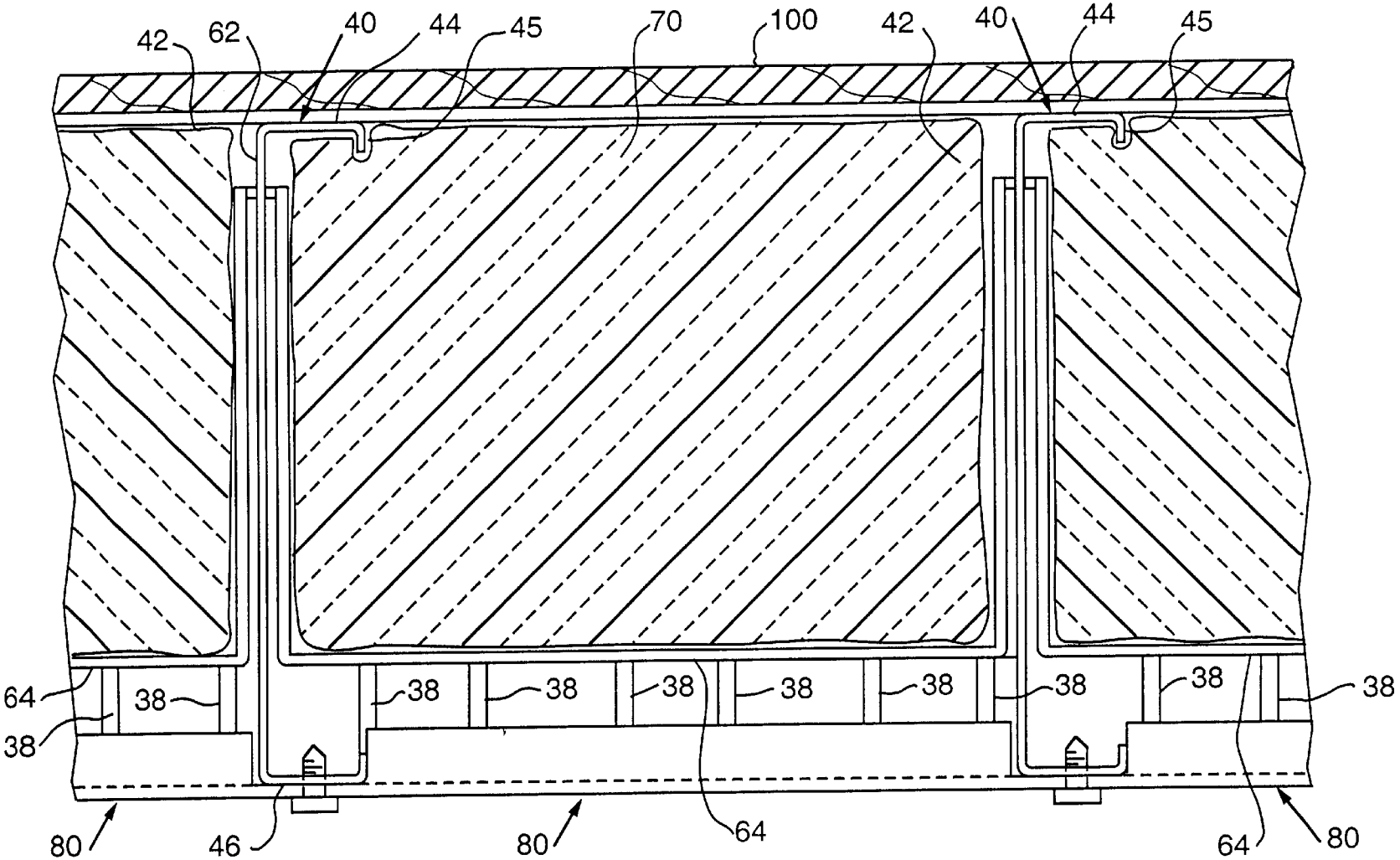
FIG. 7 is another partial cross-sectional view of a floor system of the present invention wherein insulation material is supported between the joists.

Also, to enable insulation 70 (i.e., fiberglass batting, rigid foam, etc.) to be efficiently installed between joists 40, the web portion 42 of each joist 40 may be provided with a plurality of retainer holes 62. As can be seen in FIG. 7, the retainer holes 62 are adapted to receive the ends of U-shaped wire retainers 64 therethrough. Each end of the wire retainers 64 may be provided at an angle sufficient to retain it within the retainer hole 62 after it is inserted therein. Other retainer configurations could also be used without departing from the spirit and scope of the present invention. However, in this embodiment, the retainer wires 64 are first installed and thereafter the insulation is placed over the retainers 64 from the upper side of the joists. After the insulation 70 is installed over the retainers 64, the floor sheathing material 100 may be installed. Such insulation installation method eliminates the need for installers to work from an often cramped crawl space to install the insulation. Also, the unique U-shaped configuration of the retainers 64 enables insulation that is substantially as deep as the joists to be easily installed while standing on the upper legs of the joists.

The present floor joist system 10 may also comprise unique and novel preformed blocking members 80 that are installed between joists 40 to provide lateral support thereto. A blocking member 80 may be preformed from cold rolled galvanized steel or other suitable metal in a C-shape utilizing conventional metal stamping methods. As can be seen in FIGS. 1, 6 and 7, a blocking member 80 may have a web portion 82 and two upstanding legs 84. A connection tab portion 86 that is substantially coplanar with the web 82 is formed at each end of the blocking member 80. At least one, and preferably two, fastener holes 88 are provided through each connection tab portion 86 web to enable conventional fasteners such as sheet metal screws 90 to be inserted therethrough into the lower legs 46 of corresponding joists 40. As shown in FIG. 1, the blocking members 80 may be slightly staggered relative to each other to enable the connection tab portions 86 of each blocking member 80 to be attached to the corresponding lower joist legs 46 without interfering with each other. The skilled artisan will readily appreciate that such blocking members 80 do not interfere with the installation of insulation 70 between the joists 40 and/or with the passage of ducts, wires, pipes, etc. through the openings 50 in the joists 40. See FIGS. 6 and 7. Also, by utilizing preformed blocking members 80, the often time consuming task of cutting and notching the blocking members within the field may be avoided. Furthermore, the skilled artisan will appreciate that cuts made in the field with hand tools are often ragged which can be hazardous to the installation personnel and which can result in premature failure of the part. Thus, by preforming the blocking members 80,installation time is reduced, the blocking members are safer to handle and are more structurally sound. In addition, by pre-punching fastener holes in the connection tab portions 86 of the blocking members 80, the installer is assured of proper placement of fasteners through the connection tab portion.

To install the floor system illustrated in FIG. 1, the joist rims 20 are supported on the upper wall tracks 14 of the corresponding wall structures 12. Fasteners are inserted through the lower legs 26 of the of the joist rims 20 to attach the joist rims 20 into the upper wall tracks 14 as shown. Thereafter, the joists 40 are installed between the joist rims 20 at desired intervals. It will be appreciated that because the joist rims 20 are provided with the integrally formed attachment tabs 30 at predetermined intervals, the installers do not have to "layout" each joist rim 20 at the construction site, thus, reducing the amount of time required to install the floor system 10. The end 41 of each joist 40 is abutted against the corresponding joist rim 20 adjacent the appropriate corresponding attachment tab 30 and the attachment tab 30 is attached thereto by conventional fasteners inserted through holes 34 in the attachment tab 30. If desired, the lower legs 46 of each joist 40 may be attached to the lower leg 26 of the corresponding joist rim 20 with fastener screws. Similarly, the upper legs 44 of the joists 40 may be fastened to the upper leg 24 of the corresponding joist rim 20 through the preformed holes 25. After the joists 40 have been installed, blocking members 80 may be installed as described above at appropriate intervals. Thereafter, the U-shaped retainers 64 may be installed in the holes 62 in the joists 40, if insulation is desired. The insulation 70 is then installed on the retainers 64. To complete the floor structure 10, conventional sheathing material 100 such as plywood may be screwed to the top legs 44 of the joists and the joist rim. If desired, ductwork, piping, wiring may be inserted through the openings 50 in the joists 40 and through the openings 36 in the joist rims 20.

Figure 8:
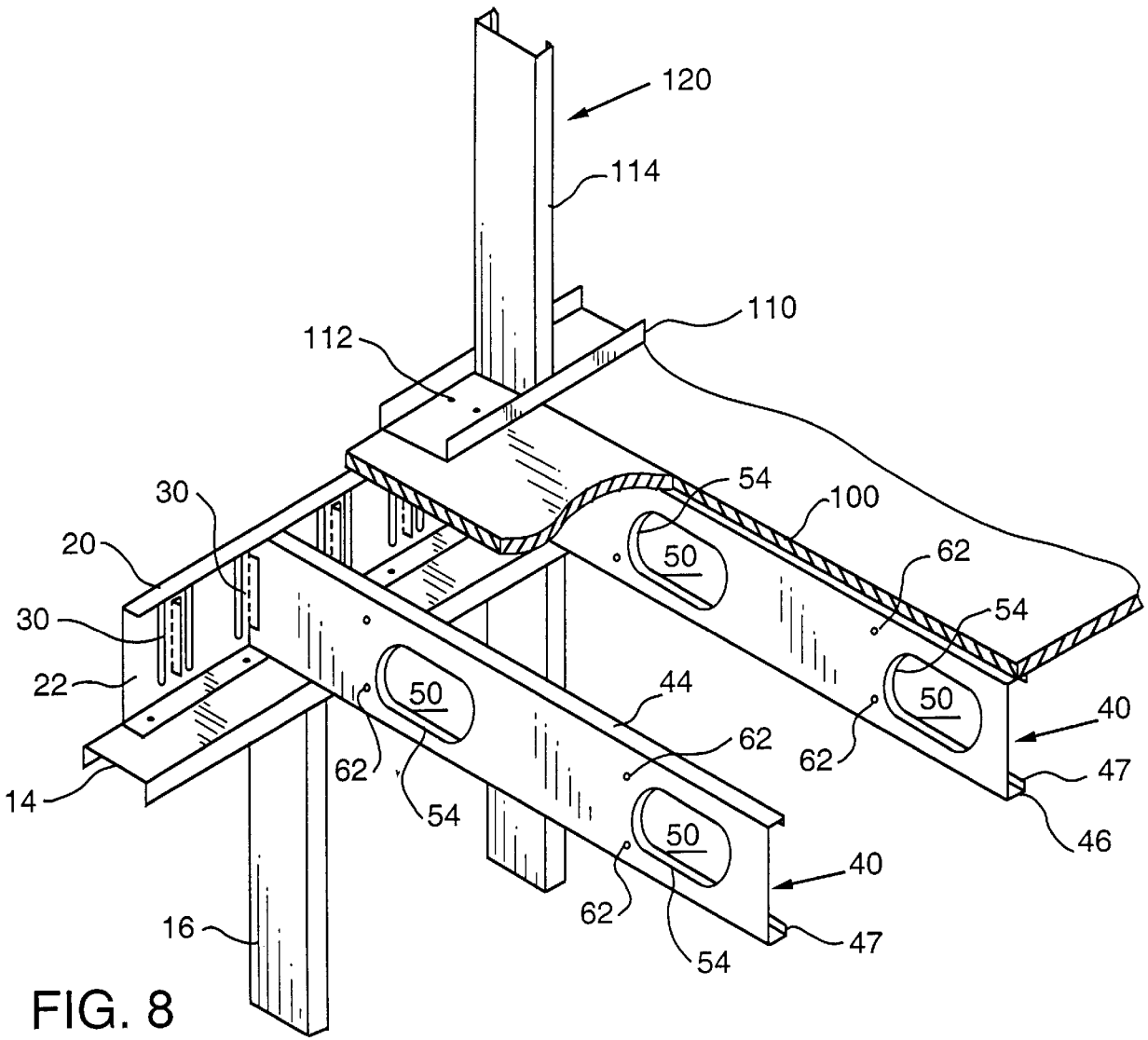
FIG. 8 is another partial perspective view of the floor system of the present invention illustrating a portion of an upper wall structure attached thereto.

The skilled artisan will also appreciate that the floor system of the subject invention may be used in multiple story applications as shown in FIG. 8. As can be seen in that Figure, after the sheathing 100 is attached to the joists 40 and joist rim 20, an additional C-shaped "lower" wall track 10 may be attached to the sheathing 100 by fastener screws. An appropriate collection of vertical C-shaped wall studs 114 may be affixed to the lower track 110 in a known manner to form a wall structure 120. It will be further appreciated that the wall structure 120 may be fabricated from conventional wood studs in a known manner.

Figure 9:
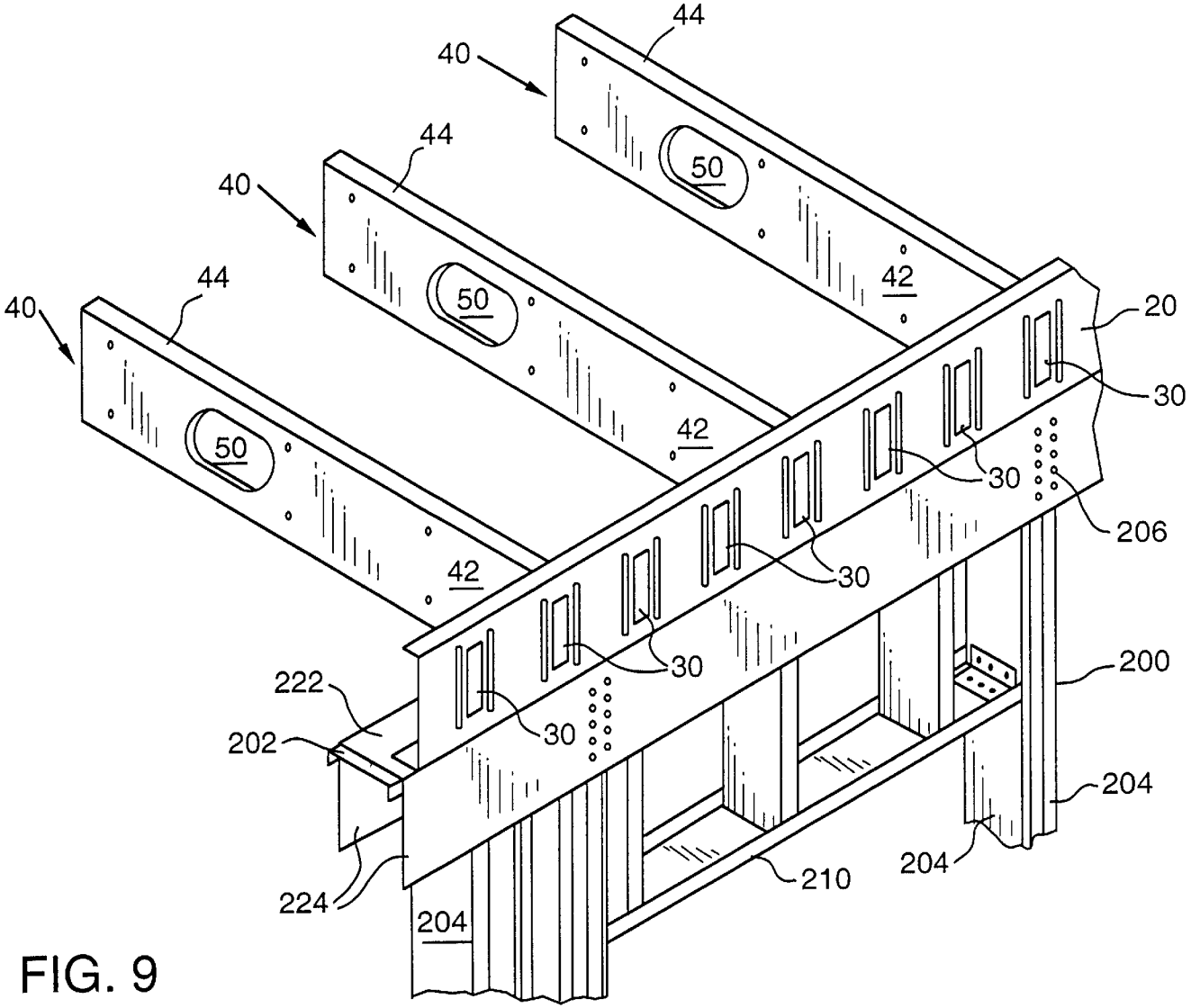
FIG. 9 is a partial perspective view of a floor system of the present invention attached to a wall structure having a door or window opening therein.

FIG. 9 illustrates use of a floor system 10 of the present invention in connection with a wall structure 200 that has an opening 210 for a door or window therein. In this embodiment, a C-shaped header 220 is placed over the top track 202 of the wall structure 200 and is attached to the wall studs 204 that are arranged in back-to-back fashion adjacent the window or door opening 210. A plurality of fasteners, preferably screws, are employed to attach the header member 220 to the studs 204. Header member 220 may be fabricated from cold rolled galvanized steel or other suitable metal and have a web portion 222 that is sized to fit over the upper wall track member 202 and two legs 224 that may extend, for example, 8" from the web 222.

Figure 10:
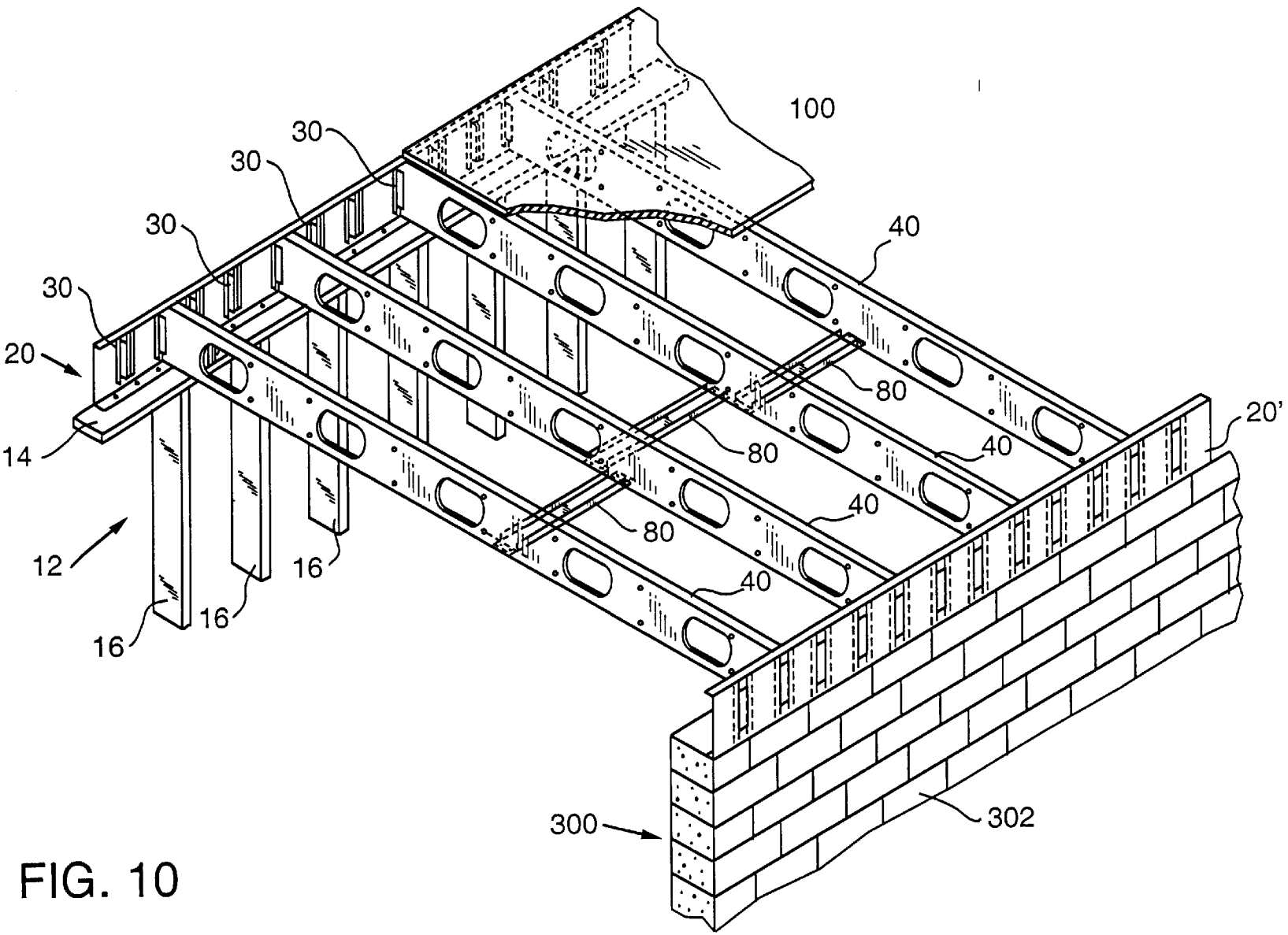
FIG. 10 is a partial perspective view of the floor system of the present invention supported between two dissimilar wall structures.

The floor system 10 of the present invention is well-suited for use in connection with support structures of dissimilar construction. For example, as can be seen in FIG. 10, a joist rim 20 may be supported on a standard wall structure 12 that is fabricated from metal tracks 14 and metal studs 16. The joist rim 20 may be attached to a top track 14 of the wall structure 12 by conventional fastener screws and techniques. In addition, a second joist rim 20' may be supported on a wall structure 300 that comprises a series of concrete blocks 302. The skilled artisan will appreciate that the joist rim 20' is attached to the wall structure utilizing conventional fasteners and construction techniques. After the joist rims (20, 20') have been installed, a series of joists 40 are suspended therebetween and attached thereto in the above-described manners. Blocking members 80 may also be installed between the joists 40. If desired, retainer members and insulation (not shown) may be installed between the joists as described above and conventional sheathing material 100 may be affixed to the joists 40.

Figure 11:
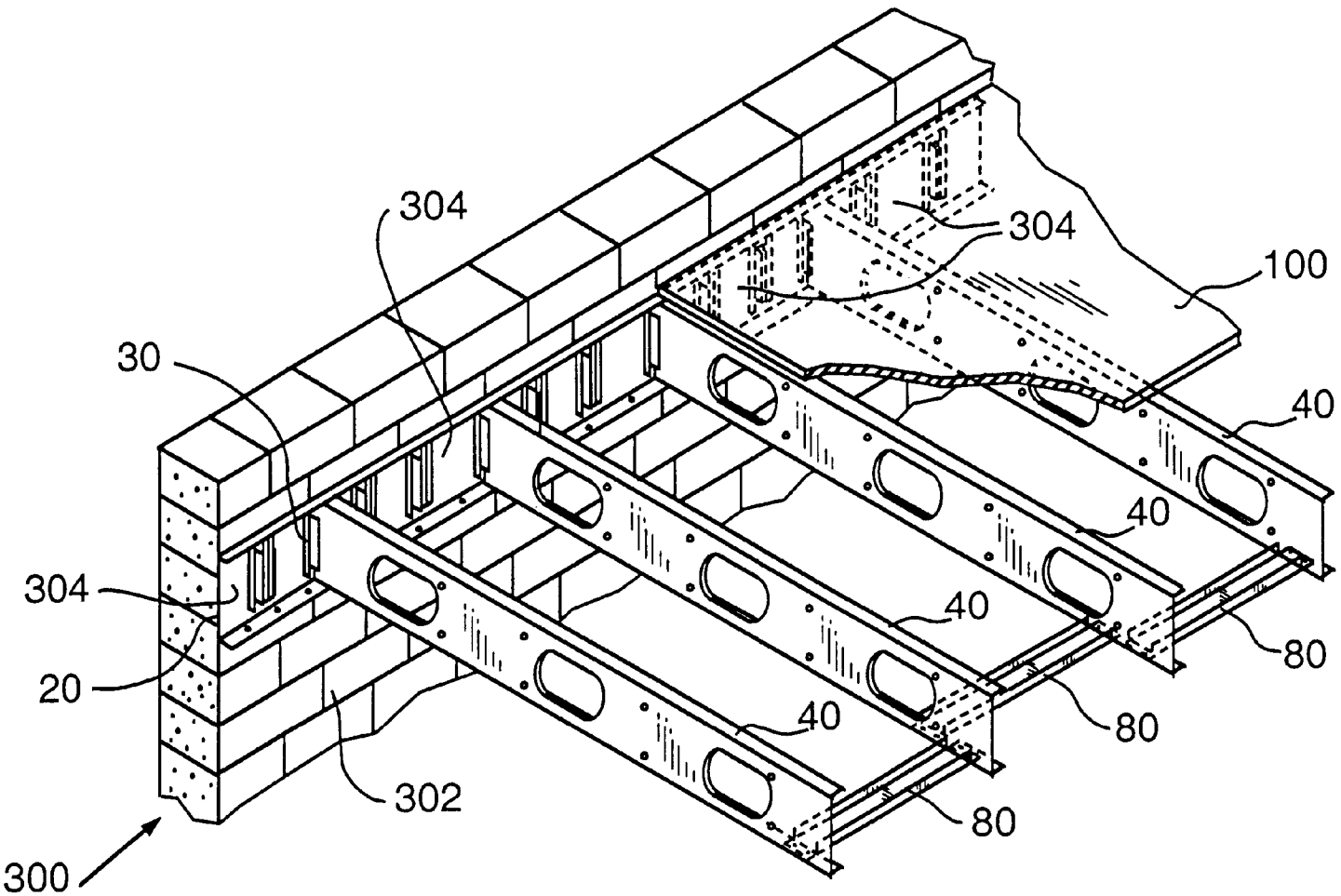
FIG. 11 is a partial perspective view showing a floor support system of the present invention attached to a concrete block support wall.

FIG. 11 depicts the floor system 10 of the present invention wherein one of the joist rims 20 is attached to the side of a wall structure 300 that is fabricated from concrete blocks 302. Those of ordinary skill in the art will appreciate that the joist rim 20 may be attached to the wall structure 300 utilizing conventional concrete screws 304 or other suitable fasteners.

Figure 12:
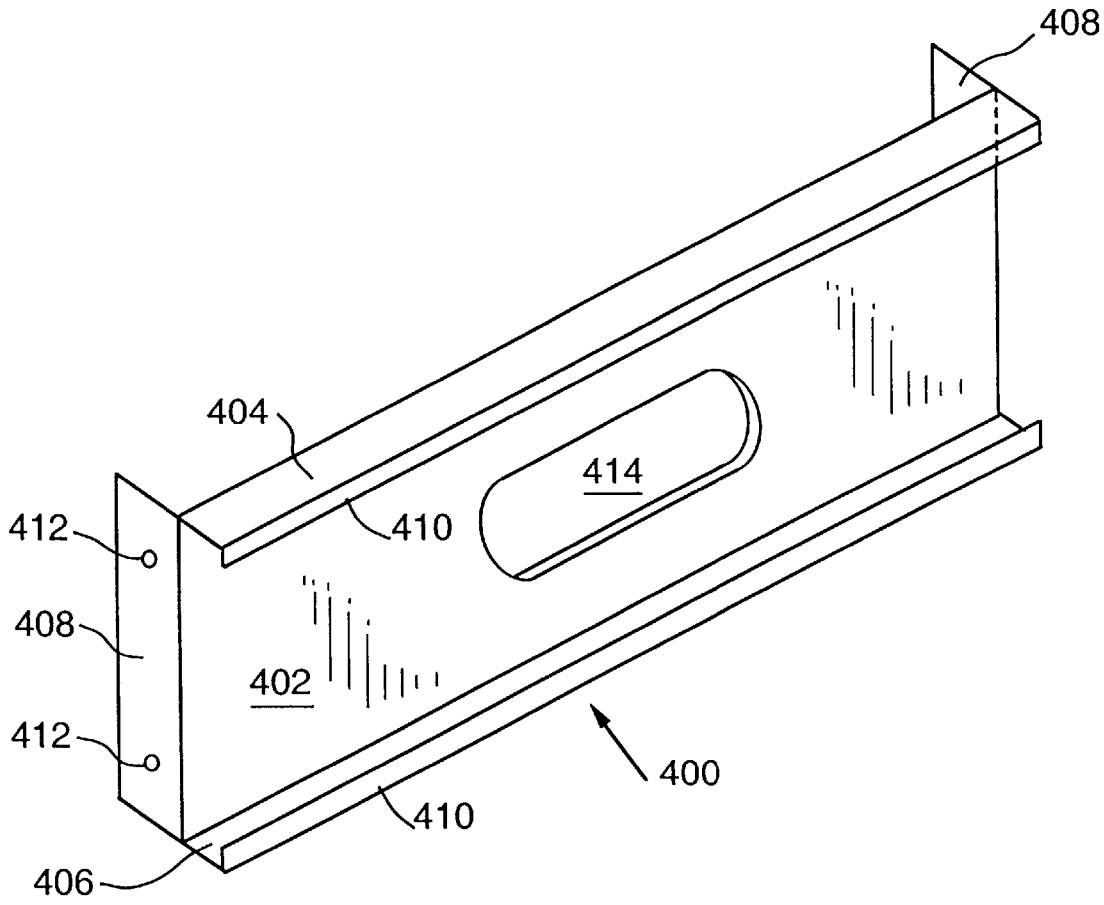
FIG. 12 is a perspective view of another embodiment of a blocking member of the present invention.
Figure 13:
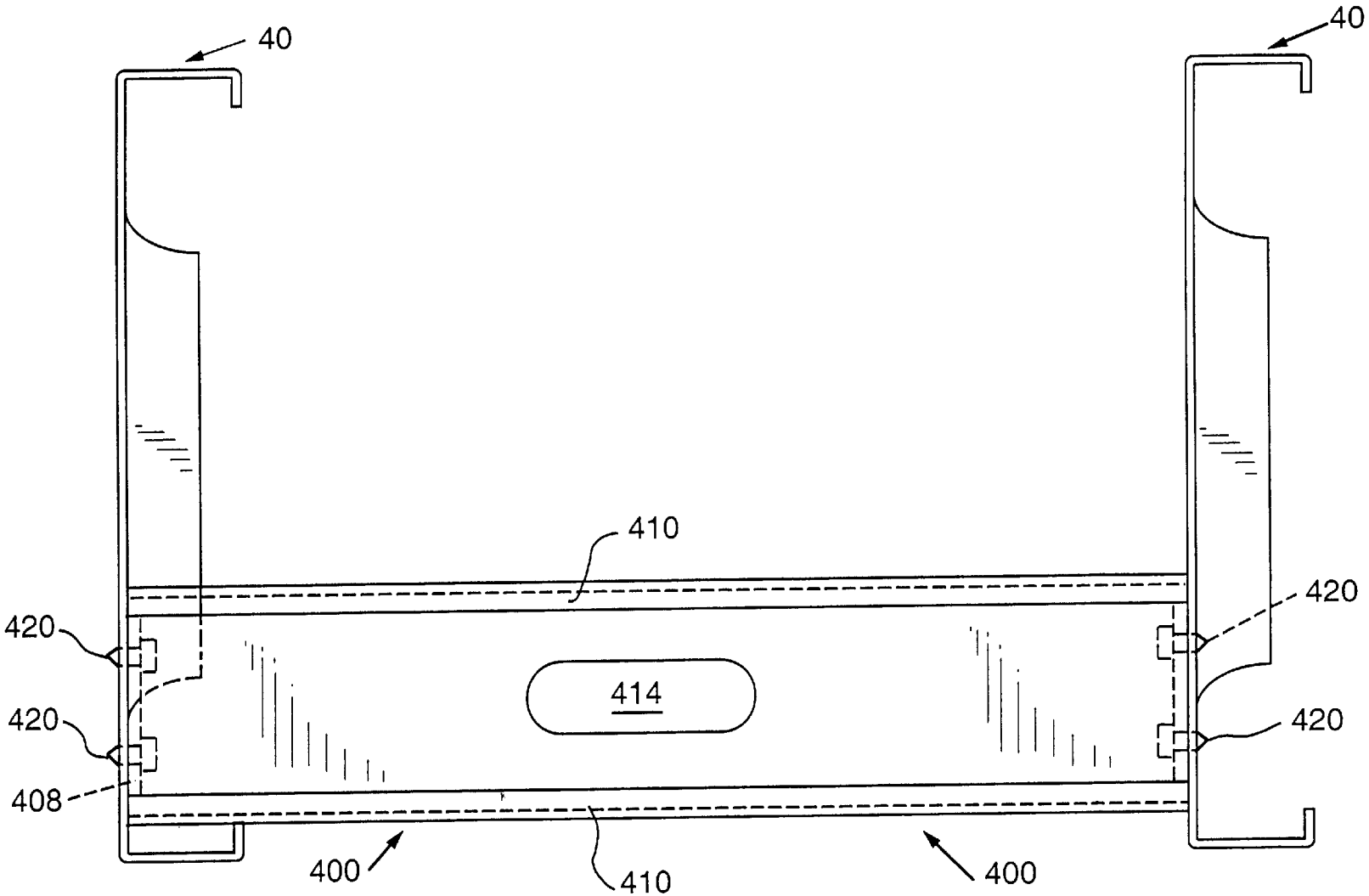
FIG. 13 is a partial end assembly view showing the blocking member of FIG. 12 attached to two joists.

FIGS. 12 and 13 depict an alternative blocking member 400 of the present invention which can be used to provide lateral support to the joists 40. As can be seen in those Figures, the blocking member 400 is essentially C-shaped and has a web portion 402 and two leg portions (404, 406) that are integrally formed with the web portion 402. An attachment tab 408 is provided at each end of the blocking member 400 such that each attachment tab 408 is substantially perpendicular relative to the web portion 402. In addition, to provide the blocking member 400 with additional strength, reinforcing rims 410 are formed on each leg (404, 406). To facilitate easy installation, a series of attachment holes 412 may be provided through the attachment tabs 408. Also, the web 402 of each blocking member 400 may have one or more holes 414 therein to permit wires, piping, etc. to pass therethrough. The blocking members 400 are then affixed to the joists as shown in FIG. 13 by conventional fasteners 420.

Thus, from the foregoing discussion, it is apparent that the present floor system solves many of the problems associated with prior floor systems. The unique and novel aspects of the present floor system components provide many advantages over prior floor system components. For example, the joist rim of the present invention provides improved load distribution and structural integrity characteristics when compared with prior header arrangements. This improvement may eliminate the often tedious task of vertically aligning each joist over a wall stud. Also, in some applications, the overall strength of the joist rim may negate the need for headers at window and door openings. Furthermore, as was discussed above, the various components of the present invention provide a safer floor system that is more economical and easier to install than prior floor systems. In addition, the present floor system is particularly well-suited for use in connection with a variety of different floor structure configurations and constructions. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A floor system, comprising:

a first wall;

a second wall spaced from said first wall;

a first joist rim having a first rim web and a first upper rim leg and a first lower rim leg, said first lower rim leg attached to said first wall, said first joist rim having a plurality of first tabs integrally formed in said first rim web and protruding therefrom at at least one predetermined interval;

a second joist rim having a second rim web and a second upper rim leg and a second lower rim leg, said second joist rim having a plurality of second tabs integrally formed in said second rim web, said second lower rim leg attached to said second wall such that each said second tab is aligned with a corresponding first tab to form a pair of aligned first and second tabs;

a plurality of joists wherein each said joist corresponds to a pair of aligned first and second tabs and has a first end, a second end, a joist web and an upper joist leg protruding from said joist web and a lower joist leg protruding from said joist web, said first end of each said joist oriented adjacent to said first tab of said corresponding pair of aligned first and second tabs, but is not attached to said first tab and such that a portion of said lower joist leg corresponding to said first end of said joist is received on said first lower rim joist leg and said second end of each said joist is oriented adjacent said second tab of said corresponding pair of said aligned first and second tabs, but not attached to said second tab such that a portion of said lower joist leg corresponding to said second end of said joist is received on said second lower leg of said second rim joist;

upper fasteners corresponding to each said joist and fastening a portion of said upper leg of said joist corresponding to said first end of said joist to said first upper rim leg and a portion of said upper leg corresponding to said second end of said joist to said second upper rim leg; and lower fasteners corresponding to each said joist for fastening said portion of said lower leg of said joist corresponding to said first end of said joist to said first lower rim leg of said first rim joist and said portion of said lower leg corresponding to said second end of said joist to said second lower rim of said second rim joist.

2. A floor system, comprising:

a first wall;

a second wall spaced from said first wall;

a first joist rim having a first rim web and a first upper rim leg and a first lower rim leg, said first lower rim leg coupled to said first wall;

first joist locator means integrally formed in said first rim web in first predetermined intervals;

a second joist rim having a second rim web and a second upper rim leg and a second lower rim leg, said second lower rim leg attached to said second wall;

second joist locator means integrally formed in said second rim web in second predetermined intervals which match said first predetermined intervals; and a plurality of joists, each said joist having an upper joist leg and a lower joist leg wherein one end of each said joist is oriented adjacent to one of said first joist locator means and is not attached thereto and said upper joist leg is attached to said first upper rim leg and said lower joist leg is attached to said lower rim joist leg and wherein another end of each said joist is oriented adjacent to a second joist locator means and is not attached thereto and said upper joist leg is attached to said second upper rim leg and said second lower joist leg is attached to said second lower rim leg.

3. A method of constructing a floor system, comprising:

coupling a first rim joist to a first wall, the first rim joist having a first rim web and a first upper rim leg and a first lower rim leg, the first rim joist further having a plurality of first locator tabs integrally formed in the first rim web in predetermined intervals;

coupling a second rim joist to a second wall, the second rim joist having a second rim web and a second upper rim leg and a second lower rim leg, the second rim joist further having a plurality of second locator tabs integrally formed in the second rim web in the predetermined intervals;

orienting one end of a corresponding joist adjacent to each first locator tab, but not attaching the end of the joist to the first locator tab;

attaching an upper leg of each joist to the first upper rim leg;

attaching a lower leg of each joist to the first lower rim leg;

orienting another end of each of the joists to a corresponding second locator tab, but not attaching the another end to the second locator tab;

attaching the upper leg of each joist to the second upper rim leg; and attaching the lower leg of each joist to the second lower rim leg.

* * * * *